US009488166B2

(12) United States Patent
Ishii et al.

(10) Patent No.: US 9,488,166 B2
(45) Date of Patent: Nov. 8, 2016

(54) ELECTROMAGNETICALLY DRIVEN FLUID PUMP HAVING A CENTER PLATE WITH FUNCTION OF CENTERING

(71) Applicant: TECHNO TAKATSUKI CO., LTD, Osaka (JP)

(72) Inventors: Hideki Ishii, Osaka (JP); Tsuyoshi Takamichi, Osaka (JP)

(73) Assignee: Techno Takatsuki., Ltd. (JP)

( * ) Notice: Subject to any disclaimer, the term of this patent is extended or adjusted under 35 U.S.C. 154(b) by 571 days.

(21) Appl. No.: 13/952,788

(22) Filed: Jul. 29, 2013

(65) Prior Publication Data

US 2014/0037475 A1 Feb. 6, 2014

(30) Foreign Application Priority Data

Aug. 1, 2012 (JP) ..... 2012-171412

(51) Int. Cl.
*F04B 43/04* (2006.01)
*F04B 43/02* (2006.01)

(52) U.S. Cl.
CPC ..... *F04B 43/04* (2013.01); *F04B 43/025* (2013.01)

(58) Field of Classification Search
CPC ..... F04B 43/04; F04B 43/025; F16J 3/022
USPC ..... 417/413.1; 92/99, 100
See application file for complete search history.

(56) References Cited

U.S. PATENT DOCUMENTS 2,683,580 A * 7/1954 Griswold ..... F16K 31/365 137/114
3,777,625 A * 12/1973 Andres ..... F15B 15/10 92/48
4,172,698 A * 10/1979 Hinz ..... H01L 21/312 257/E21.259
4,610,605 A * 9/1986 Hartley ..... F04B 43/0054 417/269
5,554,014 A * 9/1996 Becker ..... F04B 43/009 417/413.1
6,343,539 B1 * 2/2002 Du ..... F04B 43/0054 92/100
6,472,968 B1 * 10/2002 Ohya ..... H02K 33/16 335/229
7,647,861 B2 * 1/2010 Bessman ..... F16J 3/02 92/101
7,661,933 B2 * 2/2010 Ohya ..... F04B 45/043 417/413.1

FOREIGN PATENT DOCUMENTS

JP 2003035266 2/2003

* cited by examiner

*Primary Examiner* — Charles Freay
(74) *Attorney, Agent, or Firm* — Perman & Green, LLP

(57) ABSTRACT

There is provided an electromagnetically driven fluid pump. Even if deviation of a center plate from the diaphragm arises, centering of the center plate is carried out during the work for setting the center plate to an oscillator. The diaphragm and the center plate are fixed to the oscillator by means of a screw member, the diaphragm has a rising portion fitting to a through-hole at the center of the center plate, and the center plate has a ring-shaped rib on its surface where the screw member is inserted. The screw member is formed integrally with a washer portion and a diameter of the washer portion is nearly the same as an inner diameter of a bottom surface of the rib and the washer portion is formed so as to press a part of the rib in the case of maximum deviation of the center plate from the diaphragm.

8 Claims, 10 Drawing Sheets

(a)

(b)

(a)

(b)

(a)

(b)

(a)

(b)

ELECTROMAGNETICALLY DRIVEN FLUID PUMP HAVING A CENTER PLATE WITH FUNCTION OF CENTERING

CROSS-REFERENCE TO RELATED APPLICATIONS

This application claims priority to and the benefit of Japanese Application No. 2012-171412 filed on 1 Aug. 2012, the disclosures of which are incorporated by reference in its entirety.

TECHNICAL FIELD

The present invention relates to an electromagnetically driven fluid pump with a diaphragm to be used for aeration of a domestic septic tank, oxygen supply to a fish tank, air blow of a bubbling bath and other applied apparatuses. The present invention relates to in particular an electromagnetically driven fluid pump, wherein the diaphragm and a center plate supporting the diaphragm at the center part of the diaphragm are fixed to an oscillator with a screw, more particularly an electromagnetically driven fluid pump having a center plate with a function of centering, which is configured such that at the time of assembly, even if the center plate is in a state of deviation from the diaphragm, it is fixed to the diaphragm by fastening the screw while carrying out its centering.

BACKGROUND OF THE INVENTION

In an electromagnetically driven fluid pump with a diaphragm, a diaphragm made of, for example, a rubber is fixed at both ends of an oscillator having magnets fixed thereto, an outer periphery of the diaphragm is fixed to a frame and a pump casing, electromagnets are arranged so as to face the magnets of the oscillator, and the electromagnets are enclosed with a casing. A passage of a fluid is formed outside the diaphragm with the casing, and the oscillator is vibrated synchronously with a change in polarity of the electromagnets resulting from a change in polarity of ac power to be applied to the electromagnets, thereby vibrating the diaphragm and repeating suction and discharging of a fluid such as a liquid or gas.

A diaphragm is fixed to an oscillator as shown, for example, in FIG. 10. Namely, a fitting screw portion 107 is fixed at an end of a supporting portion 103 of an oscillator 102, to which a permanent magnet 110 is fixed. A through-hole 108 is formed at the center of the diaphragm 104 made of a rubber member or the like, and the diaphragm is sandwiched with an inner center plate 105 having a protruded portion fitting to the through-hole 108 and an outer center plate 106. The fitting screw portion 107 of the oscillator 102 is inserted in a through-hole 109 disposed at the center of the inner and outer center plates 105 and 106 and a nut 113 is fastened from the outside via a washer 112, thereby fixing the diaphragm (See, for example, JP 2003-35266 A). These inner and outer center plates 105 and 106 are made of metal or plastic, and are sandwiching the diaphragm 104 with the surfaces of the center plates being wider than that of the washer 112 and than the end surface of the supporting portion 103, thus fixing the diaphragm 104 to the oscillator 102. Thereby, the diaphragm 104 is not pressed directly onto the peripheral edge of the washer 112 or the peripheral edge at the end of the supporting portion 103, and wearing of the diaphragm 104 is prevented.

In addition, for example, a simplified structure as shown in FIG. 11(*a*) is used on a small size electromagnetically driven fluid pump. In this structure, an end portion 114 of a supporting portion 103 is formed in the same size and shape as those of a center plate 106, and an internal thread hole 115 is provided on the end portion 114 instead of the fitting screw portion 107. A diaphragm 104 and the center plate 106 are disposed in this order, and a screw 116 is screwed in the internal thread hole 115 from the center plate 106 side, and thereby the diaphragm 104 is sandwiched and is fixed between the center plate 106 and the end portion 114 of the supporting portion 103.

SUMMARY OF THE INVENTION

In the example shown in FIG. 11(*a*), a rising portion 117 is provided at the center of the diaphragm 104, and a through-hole 109, into which the rising portion 117 is fitted, is provided at the center of the center plate 106. By fitting the rising portion into the through-hole, the center plate 106 is prevented from being in a state of deviation from the diaphragm 104 during the screwing work of the screw 116, and lowering of workability is prevented.

In the case of small size pumps, down sizing and thinning of all parts and also thinning of a center plate are demanded. As the center plate is thinner, the length of the through-hole 109 in its axial direction becomes shorter, and accordingly, the height of the rising portion 117 is made lower. Therefore, a fitting length of the both becomes smaller and as a result, during the screwing work of the screw 116, the fitting gets out of place and deviation of the center plate 106 from the diaphragm 104 occurs easily. In such a case, there is a problem that workability is lowered since the rising portion 117 is again fitted to the through-hole 109. It can be considered to use any jig during the screwing work so that the fitting of the rising portion 117 and the through-hole 109 does not get out of place, but the working may be complicated.

Meanwhile, even if the fitting of the rising portion 117 and the through-hole 109 gets out of place and the diaphragm 104 and the center plate 106 are in a state of deviation, an assembly worker may not be aware of the deviation. In such a case, as shown in FIG. 11(*b*), the center plate 106 is assembled in a state of deviation. If the center plate 106 is fixed to the supporting portion 103 in a state of deviation, it causes a problem that a proper vibrating action of the diaphragm 104 cannot be obtained, pump performance is lowered, and lowering of durability of the pump due to early deterioration of the diaphragm occurs. Especially in the case of small size pumps, since a thin center plate made of plastic or the like is used, there is also a problem that the center plate is broken when receiving a biased load by screwing owing to the deviation.

The present invention has been made in the light of the above-mentioned circumstances, and an object of the present invention is to provide an electromagnetically driven fluid pump having a center plate with a function of centering, wherein in the case of fixing a diaphragm using the center plate, even if positioning of the center plate is deviated relative to the diaphragm, the center plate is adjusted to be aligned concentrically with the diaphragm by fastening the screw.

DETAILED DESCRIPTION

Figure 1:
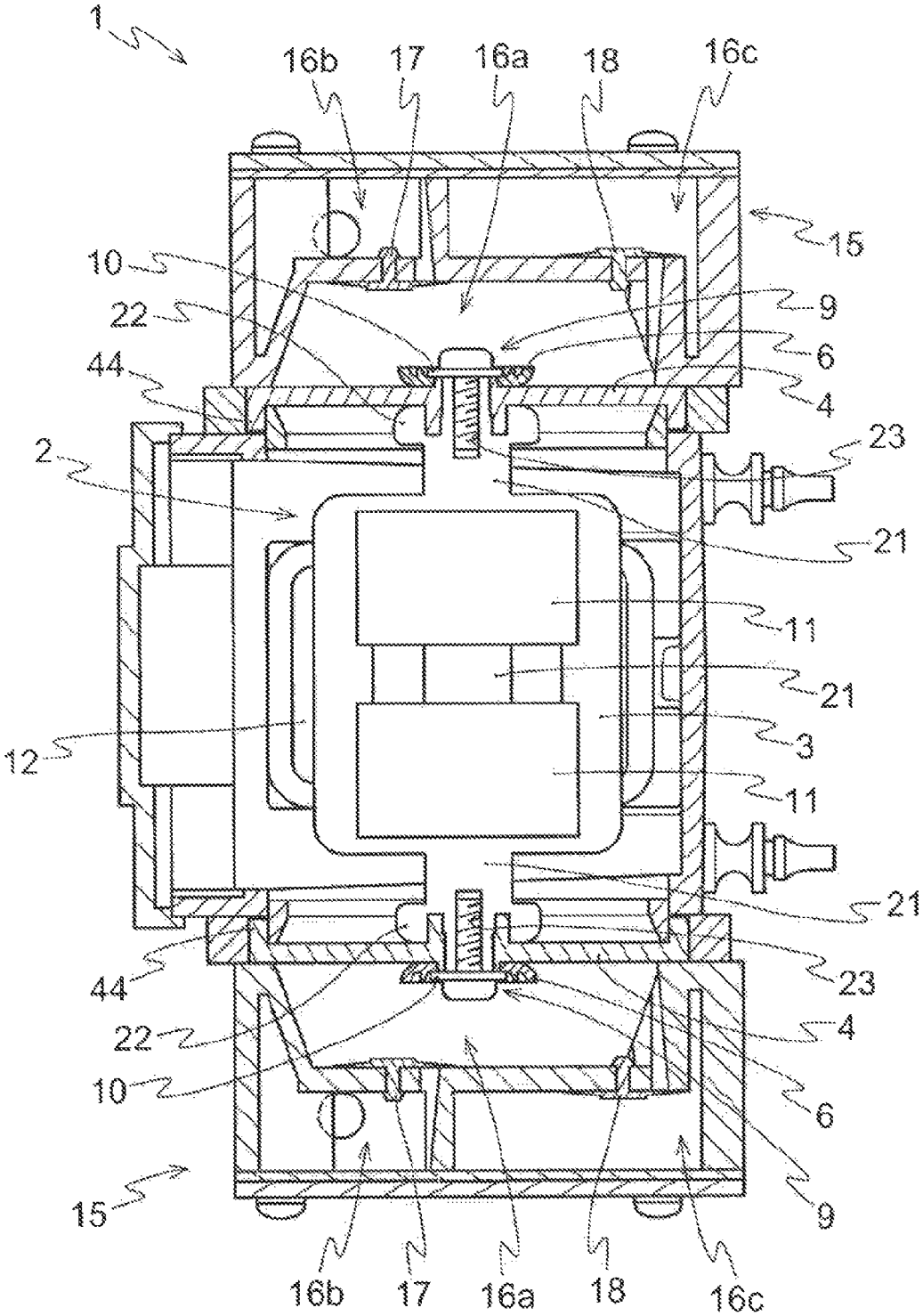
FIG. 1 is a cross-sectional view of one embodiment of the electromagnetically driven fluid pump of the present invention.

The electromagnetically driven fluid pump having a center plate with a function of centering of the present invention comprises an oscillator having permanent magnets fixed to a supporting portion and a shaft at a center portion of the supporting portion, a disc-like diaphragm disposed at least at one end of the oscillator, and electromagnets arranged so as to face the permanent magnets, in which the diaphragm is fitted to a stopper portion disposed at one end of the shaft, is inserted in the shaft, and is fixed with a screw member to be screwed in the shaft in an axial direction of the shaft via the center plate into which the shaft 21 is inserted; the diaphragm has a rising portion of a circular outer shape formed at the side of the center plate so as to fit to a through-hole provided at the center of the center plate; the center plate has, on its surface opposite to the diaphragm, a ring rib formed at the side of the outer periphery of the through-hole concentrically with the through-hole; and the screw member has a washer portion formed integrally with the screw member and a diameter of the washer portion is nearly the same as an inner diameter of a bottom surface of the rib and the washer portion is formed so as to press a part of the rib when the center plate comes off from the rising portion of the diaphragm and is subject to maximum deviation.

Here, the washer portion formed integrally with the screw member means that it encompasses a washer portion formed integrally with a screw member from the first, a washer portion produced separately from a screw member and then adhered to the screw member, and a screw member having a screw head formed so as to have a size usable as a washer even if the screw member does not have a portion recognized as a washer.

The center plate can be securely aligned concentrically with the diaphragm by making a cross-section of a wall surface of the rib at its center axis side be in a tapered or curved form so that the diameter of the rib increases in the direction from its bottom to its top.

A force for pressing the diaphragm onto the peripheral edge portion of the center plate can be relaxed and a life of the diaphragm can be extended by forming the peripheral edge portion of the center plate so as to be curved toward a direction opposite to the diaphragm.

The center plate can be produced by a process of low cost such as a die molding when the center plate is formed from a resin.

According to the present invention, the ring rib is provided on the center plate and the screw member is formed integrally with the washer portion. Therefore, even if the position of the center plate is deviated from the diaphragm, by screwing the screw member, the washer portion pushes the rib partially to be able to work for correcting the state of deviation of the center plate, and the center plate can be moved so as to be aligned concentrically with the diaphragm. Namely, if the center plate is deviated from the diaphragm, the washer portion rotates together with the screw member while pushing the top of the rib by screwing the screw member. Therefore, to the top of the rib are applied a force pushing downward and a force pushing outward, thereby moving the center plate in such a direction as correcting the deviation of the center plate. As a result, when fixing the center plate to the diaphragm by means of the screw member, even if the fitting of the rising portion of the diaphragm to the through-hole of the center plate gets out of place and the center plate is in a state of deviation, centering of the center plate can be conducted only by screwing the screw member without using a specific jig, thus enabling the centering to be carried out spontaneously without fitting again the rising portion of the diaphragm to the through-hole of the center plate and enabling workability to be improved.

Further, since the center plate and the diaphragm are prevented from being fixed in a state of deviation, not only a proper action of the diaphragm can be obtained and lowering of pump performance can be prevented but also early deterioration of the diaphragm can be prevented and lowering of durability of the pump can be prevented. Further, even in the case of a thin center plate, it is possible to prevent breakage thereof due to a biased load during screwing work.

Figure 2:
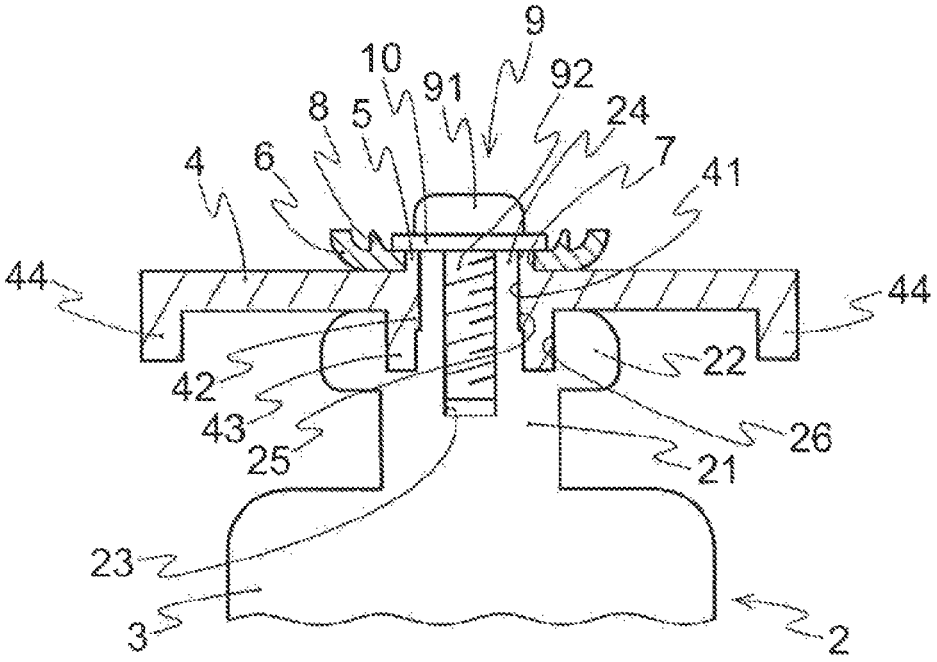
FIG. 2 is a cross-sectional view for explaining the fitting of the center plate and the oscillator in the embodiment of FIG. 1.

Next, the electromagnetically driven fluid pump having a center plate with a function of centering of the present invention is explained by referring to the drawings. As shown in FIGS. 1 and 2, the electromagnetically driven fluid pump 1 having a center plate with a function of centering according to the present invention comprises an oscillator 2 having permanent magnets 11 fixed to a supporting portion 3 and a shaft 21 at a center portion of the supporting portion 3, a disc-like diaphragm 4 disposed at both ends of the oscillator 2, and electromagnets 12 arranged so as to face the permanent magnets 11, and is configured such that the diaphragm 4 is fitted to a stopper portion 22 disposed at both ends of the shaft 21, and is fixed with a screw member 9 to be screwed in the shaft 21 in an axial direction of the shaft 21 via the center plate 6 into which the shaft 21 is inserted. In the present invention, the diaphragm 4 has a rising portion 5 of a circular outer shape formed at its center plate 6 side so as to fit to a through-hole 7 provided at the center of the center plate 6, the center plate 6 has, on its surface opposite to the diaphragm 4, a ring rib 8 formed at the side of the outer periphery of the through-hole 7 concentrically with the through-hole 7, and the screw member 9 has a washer portion 10 formed integrally with the screw member 9 and a diameter of the washer portion 10 is nearly the same as an inner diameter of a bottom surface of the rib 8 and the washer portion 10 is formed so as to press a part of the rib 8 when the center plate 6 comes off from the rising portion 5 of the diaphragm 4 and is subject to maximum deviation.

The oscillator 2 is, as shown in FIGS. 1 and 2, is composed of the supporting portion 3 formed in the form of a rectangular frame and having two permanent magnets 11 fixed in the proximity of the both short sides in the frame, the cylindrical shaft 21 disposed so as to penetrate between the center portions of both short sides of the supporting portion 3 except the portions where the permanent magnets are fixed and extend outward from the both short sides, and the disc-like stopper 22 formed at both ends of the shaft 21 concentrically with the shaft 21.

An internal thread hole 23 to be screwed with the screw member 9, which is open to the diaphragm side, is provided in the center of the stopper 22. Around this internal thread hole 23, a cylindrical rising portion 24 to be fitted to a through-hole 41 of the diaphragm 4 explained infra is disposed, and around this rising portion 24, a ring concave portion 25 and two round hole portions 26 to be fitted to a ring convex portion 42 and two round bar protrusions 43, respectively of the diaphragm 4 which are explained infra are disposed. The supporting portion 3, the shaft 21 and the stopper 22 are preferably made of a non-magnetic material, and for example, can be formed from a plastic material such as PA (polyamide) or PBT (polybutylene terephthalate).

Figure 3:
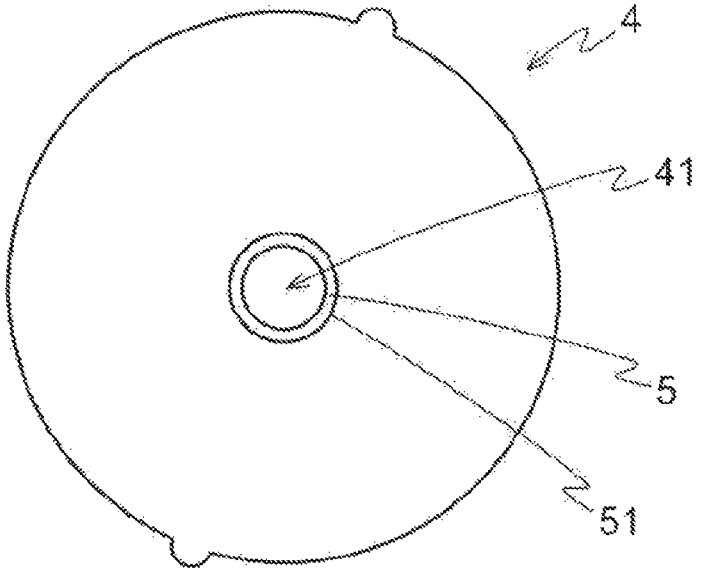
FIG. 3 is an explanatory view of the diaphragm of the present invention.
Figure 3:
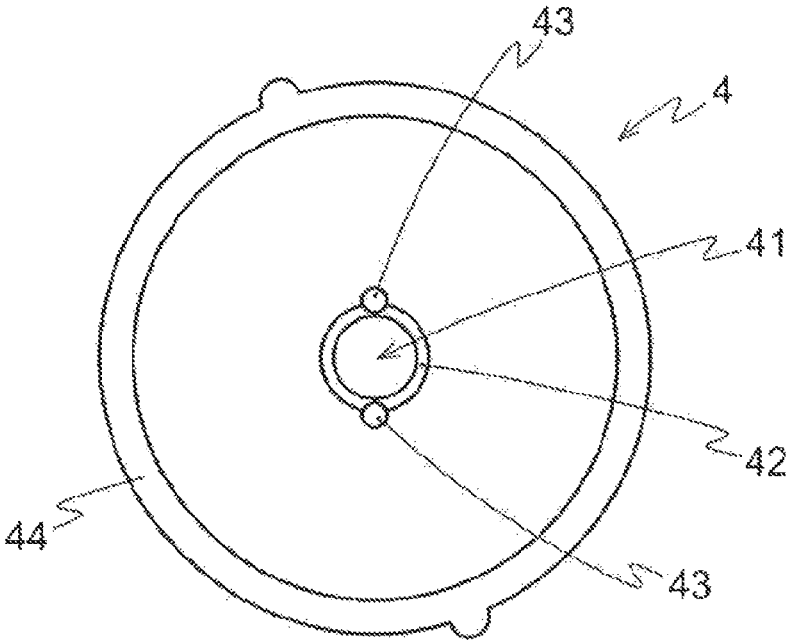

The surface of the diaphragm 4 at the center plate 6 side is shown in FIG. 3(*a*) and the surface thereof at the oscillator 2 side is shown in FIG. 3(*b*). As shown in the respective figures, the diaphragm 4 is formed in a circular outer shape, and the through-hole 41, in which the rising portion 24 of the stopper 22 is inserted, is disposed at the center of the diaphragm, and a rising portion 5 having a circular plane shape and being fitted to a through-hole 7 of the center plate 6 is disposed on the center plate 6 side surface around the through-hole 41. At the oscillator 2 side surface of the diaphragm, the ring convex portion 42 to be fitted to the ring concave portion of the stopper 22 and two round bar protrusions 43 which are to be fitted to the two round hole portions 26 of the stopper 22 and prevent deviation from the stopper 22 in the rotational direction are disposed around the through-hole 41. A flange portion 44 to be fixed to a casing 15 (See FIG. 1) is provided at the outer periphery edge of the diaphragm. A material of the diaphragm 4 is not limited particularly as far as a volume of a chamber containing a fluid can be changed according to a reciprocating motion of the oscillator 2 and flexibility realizing the pump action explained infra and a sealing property at an interface with the casing 15 are assured. The diaphragm 4 can be made using, for example, polyethylene propylene rubber (EPDM), a fluorine-containing rubber, or the like.

Figure 4:
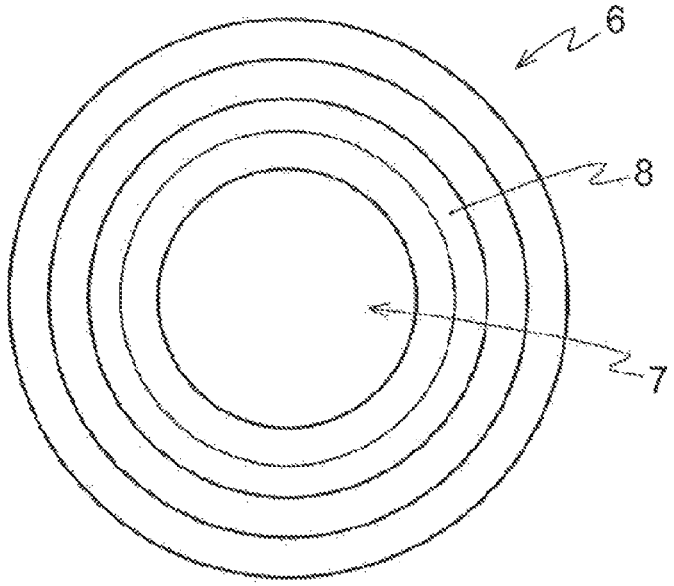
FIG. 4 is an explanatory view of the center plate of the present invention.
Figure 4:
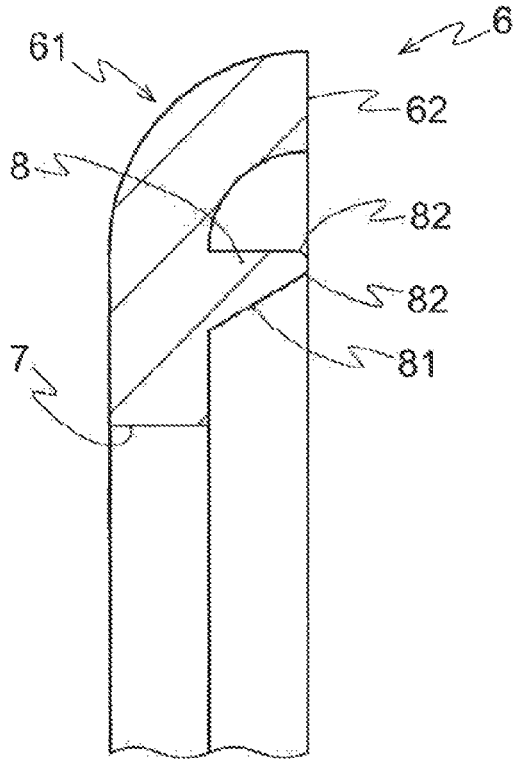

The surface of the center plate 6 at the opposite side of the diaphragm 4 is shown in FIG. 4(*a*), and an enlarged cross-section of the outer peripheral edge of the center plate is shown in FIG. 4(*b*). As shown in the respective figures, the center plate 6 is formed in a circular outer shape, and the through-hole 7 to be fitted to the rising portion 5 of the diaphragm 4 is disposed concentrically with the outer shape thereof, and the rib 8 protruded on the surface opposite the diaphragm 4 in the form of ring and being concentric with the through-hole 7 is formed at the outer periphery side of the through-hole 7. The peripheral portion of the center plate 6 is formed being curved toward the opposite side of the diaphragm 4, and the end 62 of the curved portion is formed nearly at the same height as that of the rib 8. The cross-section of the wall surface 81 of the ring-shaped rib 8 is in the tapered form so that the inner diameter of the ring increases from the bottom to the top thereof, and the corners 82 of the top of the ring are in the round form at both of inner diameter side and outer diameter side. In this embodiment, the rib 8 is formed with a size assuring that when deviation of the center plate 6 from the diaphragm 4 is maximum, a portion of the rib 8 being in the most proximity of the center of the diaphragm 4 is located at nearly the same position in a radial direction as the peripheral edge 51 of the rising portion 5 of the diaphragm 4 (See FIG. 3). Further, the center plate 6 is in the above-mentioned curved form in a range from its position being nearly the same as the outer diameter of the rib 8 to its outer peripheral edge. The cross-section of the wall surface 81 of the rib 8 is not limited to the tapered form, and may be, for example, in the curved form. A material of the center plate 6 is not limited particularly as far as it has load resistance and rigidity being capable of withstanding a fastening load by the screw member 9 and stably holding the center portion of the vibrating diaphragm 4. The center plate 6 can be formed from a plastic material such as PBT (polybutylene terephthalate) or a metallic material.

As shown in FIG. 2, the screw member 9 is composed of, for example, a body of the screw member comprising a head portion 91 and a shank 92 and a washer portion 10. The size of the washer portion 10 is such that when the through-hole 7 of the center plate 6 gets out of place from the rising portion 5 of the diaphragm 4 and deviation of the center plate 6 from the diaphragm 4 is maximum, the washer portion 10 can press at least a part of the top of the rib 8, in other words, a difference between a radius of the washer portion 10 and a radius of the shank 92 is larger than a difference between a radius of the through-hole 7 of the center plate 6 and an inside radius of the of the top of the rib 8 and is nearly the same as the inner diameter of the bottom of the rib 8. This washer portion 10 is formed integrally with the body of the screw member. Therefore, when the screw member 9 is screwed in and moves in parallel with the shaft 21, the washer portion 10 moves while being kept nearly perpendicularly with the shaft 21, and thereby, a centering action of the center plate 6 to be explained below in detail is obtained. The washer portion 10 may be produced being formed integrally with a screw member, the washer portion may be produced separately from the body of the screw member and then adhered to the body of the screw member to be integrally formed together, and the screw member may have the screw head 91 formed so as to have a size which can be used as a washer without having a portion recognized as a washer.

Figure 5:
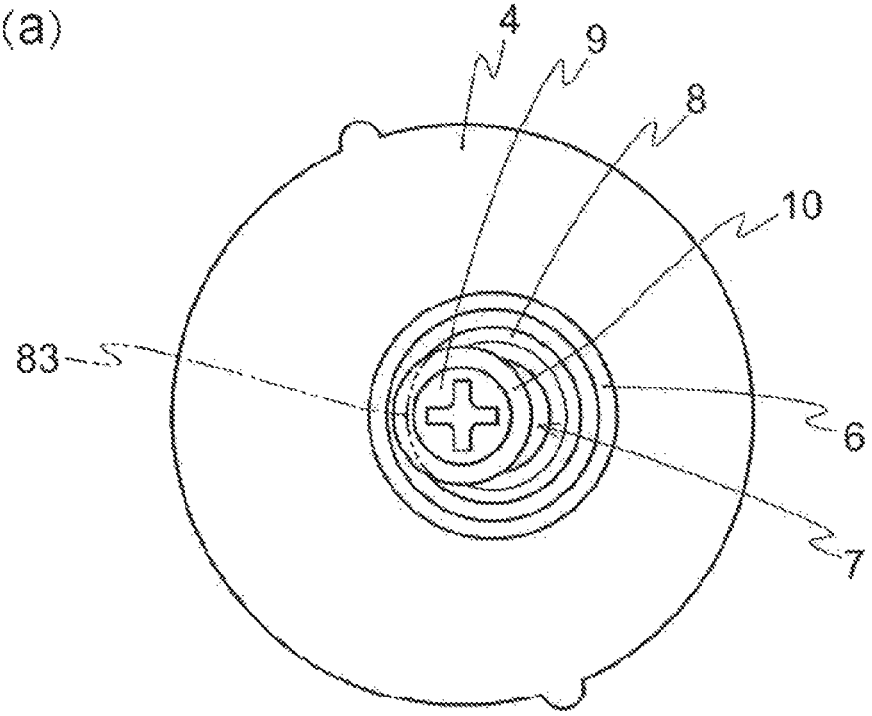
FIG. 5 is a view for explaining an initial state of the centering action of the center plate of the present invention.
Figure 5:
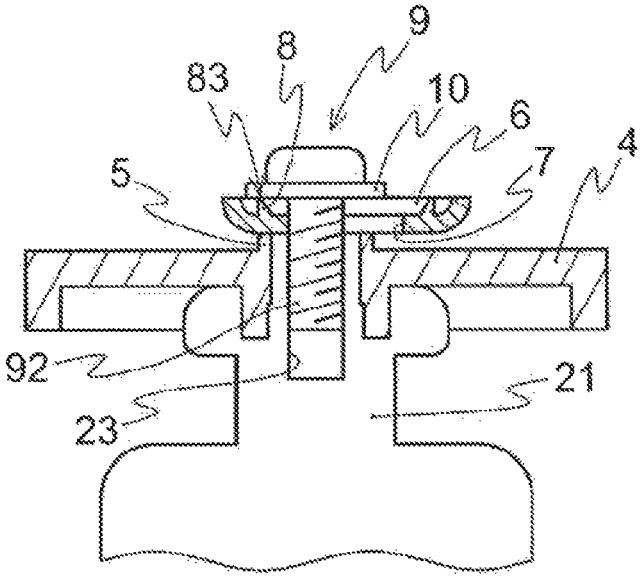
Figure 6:
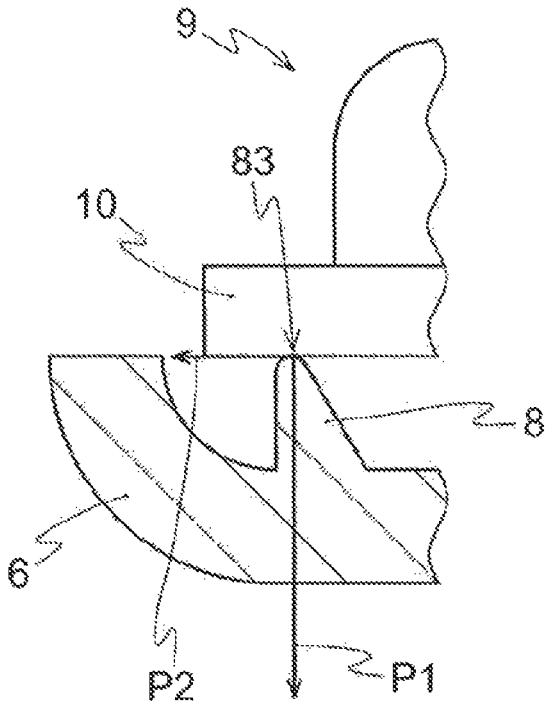
FIG. 6 is a view of an enlarged cross-section of the rib of the center plate of the present invention shown in FIG. 5.
Figure 7:
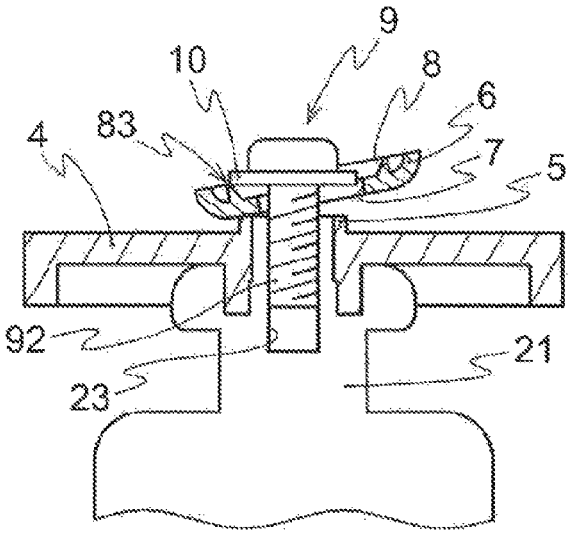
FIG. 7 is a view for explaining an intermediate state of the centering action of the center plate of the present invention.

Next, the centering action of the center plate of this embodiment is explained. When the screw member 9 is screwed in such a state that the through-hole 7 of the center plate 6 gets out of place from the rising portion 5 of the diaphragm 4 and deviation of the center plate 6 from the diaphragm 4, namely deviation from the screw member 9 is large, as shown in FIG. 5(*a*) showing the washer portion 10 side and in FIG. 5(*b*) showing the cross-section thereof, a part of the center plate 6 rides on the rising portion 5 of the diaphragm 4, and meanwhile, since the washer portion 10 has such a size as pressing a part of the rib 8, a part of the peripheral edge of the washer 10 is in a state of pressing a contacting portion 83 which is a part of the top portion of the rib 8. By further screwing the screw member 9 in a clockwise direction, as shown in FIG. 6, at the contacting portion 83, there occur a force shown by an arrow P1 and directing toward the axial direction of the screw member 9 and a force shown by an arrow P2 which is generated by the washer portion 10 rotating while pressing the contacting portion 83 and is directing toward the outward direction of the center plate 6. The force shown by an arrow P1 acts so as to press the center plate 6 onto the diaphragm 4 at the contacting portion 83 while the force shown by an arrow P2 presses the contacting portion 83 which is a part of the top portion of the rib 8 toward the outward direction of the center plate 6. Therefore, the center plate 6 receives a force in a direction rotating counter-clockwise in FIG. 5(*b*), and as shown in FIG. 7, a portion of the center plate 6 located opposite to the contacting portion 83 is in a lifted up state.

Figure 8:
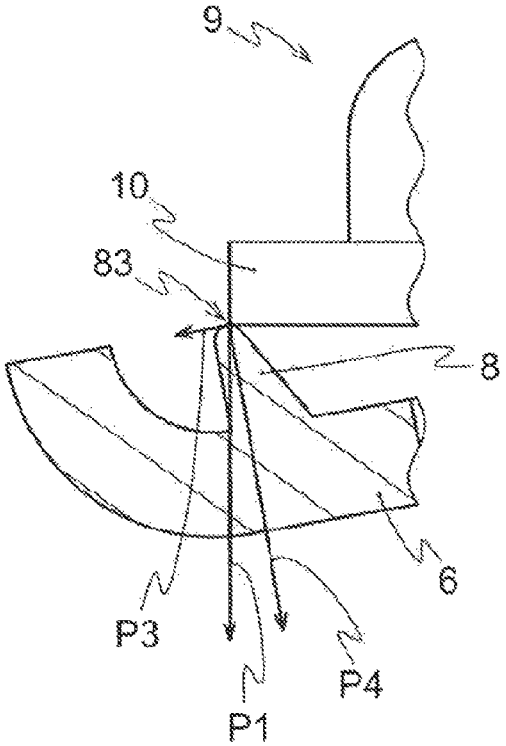
FIG. 8 is a view of an enlarged cross-section of the rib of the center plate of the present invention shown in FIG. 7.

By further screwing the screw member 9, as shown in FIG. 8, the force shown by the arrow P1 and directing toward the axial direction of the screw member 9 acts as a component of force shown by the arrow P3 and directing toward the outside of the center plate 6 and a component of force shown by the arrow P4 in a direction vertical to the component of force shown by the arrow P3. As a result, the center plate 6 is moved outward in its radial direction by the above-mentioned force shown by an arrow P2 and the force shown by the arrow P3 until the top of the rib 8 contacting the washer portion 10 is positioned at an outer side of the peripheral edge of the washer portion 10, namely until the whole of the washer portion 10 is retained inside the ring form of the rib 8, and further, the washer portion 10 is guided on the wall surface 81 of the rib 8 so as to be retained on the bottom of the rib 8 having an inner diameter being nearly the same as the diameter of the washer portion 10. Thus, the center plate 6 is subjected to centering concentrically with the diaphragm 4.

When the center plate 6 is not subject to deviation largely to an extent such that the washer portion 10 presses the top of the rib 8 and is subject to deviation to an extent such that the peripheral edge of the washer portion 10 abuts upon the wall surface 81 of the rib 8, the center plate 6 is subjected to centering concentrically with the diaphragm 4 by guiding the washer portion 10 on the wall surface 81 of the rib 8 so that the washer portion 10 is retained on the bottom of the rib 8 without passing a process of generation of forces shown by the arrows P1 to P4.

In this embodiment, the stopper portions 22 are provided at both ends of the shaft 21, and the diaphragms 4 and the center plates 6 are provided at both ends of the oscillator 2. Otherwise, it is possible to employ a configuration such that the stopper portion is provided only at one end of the shaft 21 and the diaphragm and the center plate are provided only at the side where the stopper portion is provided.

Figure 9:
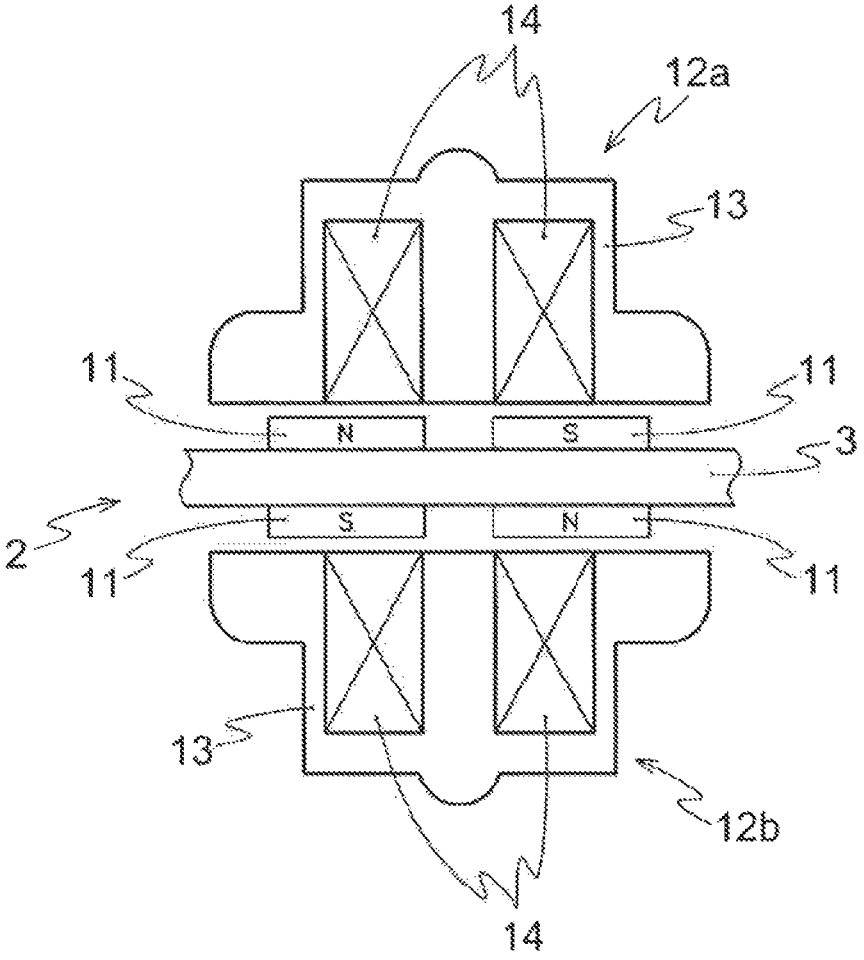
FIG. 9 is a diagrammatical view of the electromagnets and the permanent magnets of the electromagnetically driven fluid pump shown in FIG. 1.
Figure 10:
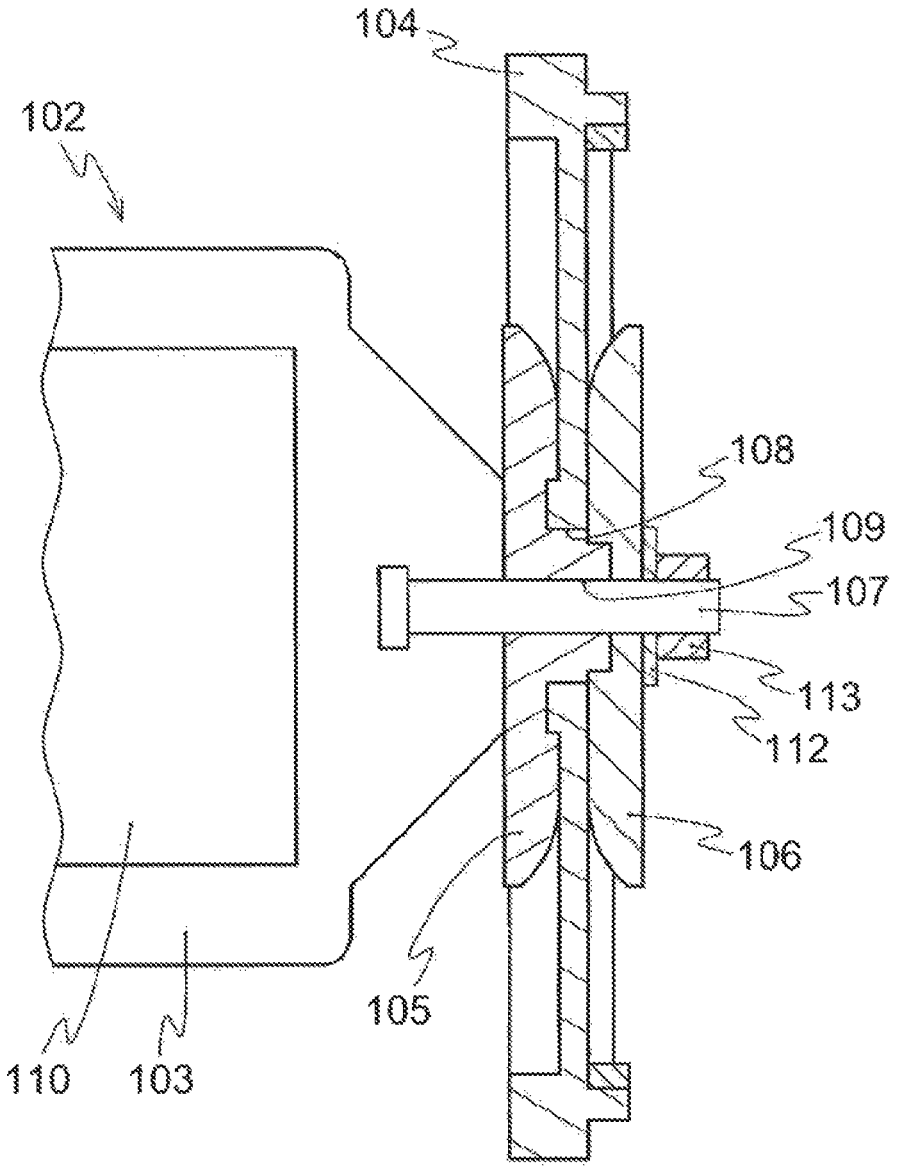
FIG. 10 (Prior art)
FIG. 10 is a cross-sectional view showing one example of the fitting of an oscillator and center plates of a conventional electromagnetically driven fluid pump.
Figure 11:
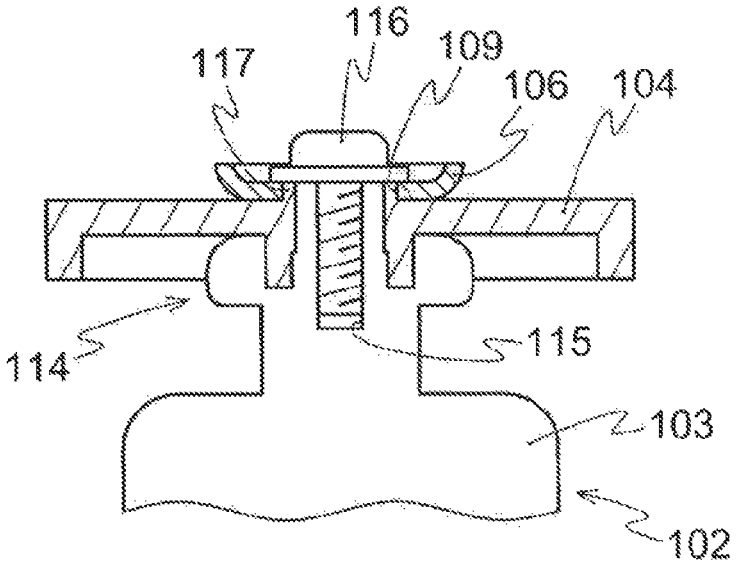
FIG. 11 (Prior art)
FIG. 11 is a cross-sectional view showing another example of the fitting of an oscillator and a center plate of a conventional electromagnetically driven fluid pump.
Figure 11:
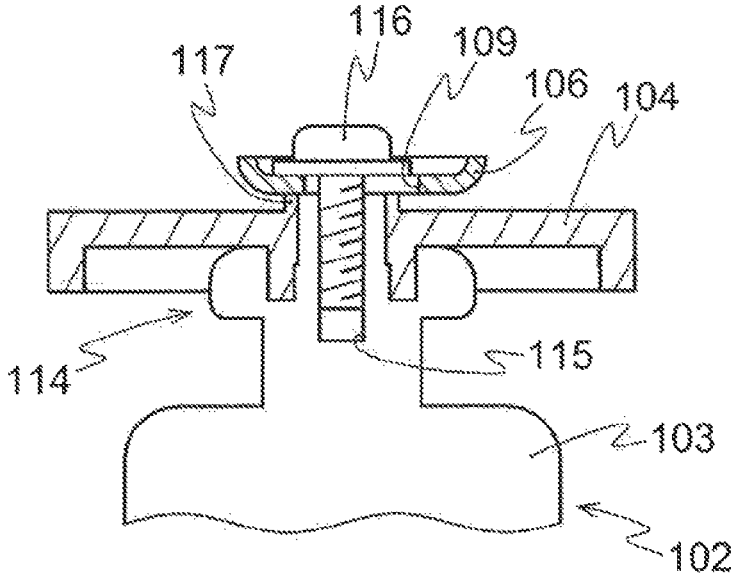
FIG. 11 (Prior art)

The permanent magnets 11 and the electromagnets 12 are configured in the same manner as in prior arts. The permanent magnets 11 are formed in a shape of a flat plate as shown in FIG. 9, and are fixed to the supporting portion 3 of the oscillator 2. In the embodiment shown in FIG. 9, one side of the left hand permanent magnets 11 facing the electromagnet 12*a* is magnetized to a north magnetic pole and another side facing the electromagnet 12*b* is magnetized to a south magnetic pole, and one side of the right hand permanent magnets 11 facing the electromagnet 12*a* is magnetized to a south magnetic pole and another side facing the electromagnet 12*b* is magnetized to a north magnetic pole. Otherwise, each of the permanent magnets may be magnetized reversely. As the permanent magnets 11, a ferrite magnet, a rare-earth magnet, or the like can be used.

With respect to the electromagnets 12, as shown in FIG. 9, a pair of electromagnets 12*a* and 12*b* are disposed with the permanent magnets being interposed therebetween, and each of the electromagnets 12*a* and 12*b* is composed of an E-shaped electromagnet core 13 and a magnet coil 14 wound on the electromagnet core 13. By flowing an ac current in the electromagnets 12*a* and 12*b*, in one electromagnet (for example, the electromagnet 12*a*), its center part is magnetized to a north magnetic pole and the both sides thereof are magnetized to a south magnetic pole. In another electromagnet (for example, the electromagnet 12*b*), its center part is magnetized to a south magnetic pole and the both sides thereof are magnetized to a north magnetic pole. Conversion to a north magnetic pole and a south magnetic pole is repeated. Thereby, a attractive force and a repelling force are generated repeatedly due to a magnetic action between the electromagnets 12 and the permanent magnets 11 fixed to the supporting portion 3 of the oscillator 2, thereby allowing the oscillator 2 to undergo a reciprocating motion in its axial direction and vibrating the diaphragm 4.

The operation of the electromagnetically driven fluid pump 1 of this embodiment is the same as that of a pump of a conventional structure. As shown in FIG. 1, the casing 15 is divided into a compression chamber 16*a* at the diaphragm 44 side, a suction chamber 16*b* and a discharge chamber 16*c* by means of partition walls, and a suction valve 17 is provided between the compression chamber 16*a* and the suction chamber 16*b*. When the volume of the compression chamber 16*a* becomes larger due to the vibration of the diaphragm 4 and the pressure therein decreases, the suction valve 17 opens and a fluid flows thereinto from the suction chamber 16*b*. The suction valve 17 is configured so as to close when the volume of the compression chamber 16*a* becomes smaller and the pressure therein increases. Meanwhile, a discharge valve 18 is provided between the compression chamber 16*a* and the discharge chamber 16*c*. When the volume of the compression chamber 16*a* becomes smaller due to the vibration of the diaphragm 4 and the pressure therein increases, this discharge valve 18 opens and a fluid such as air in the compression chamber 16*a* is discharged into the discharge chamber 16*c*.

EXPLANATION OF SYMBOLS

1 Electromagnetically driven fluid pump
2 Oscillator
21 Shaft
22 Stopper portion
23 Internal thread hole
3 Supporting portion
4 Diaphragm
5 Rising portion of diaphragm
6 Center plate
7 Through-hole of center plate
8 Rib
9 Screw member
10 Washer portion
11 Permanent magnet
12 Electromagnet

What is claimed is:

1. An electromagnetically driven fluid pump having a center plate with a function of centering, comprising:

an oscillator having permanent magnets fixed to a supporting portion and a shaft at a center portion of the supporting portion, a disc-like diaphragm disposed at least at one end of the oscillator, electromagnets arranged so as to face the permanent magnets, and a screw member fixing the diaphragm to the oscillator, wherein the shaft is inserted in the center plate and the diaphragm is fitted to a stopper portion disposed at one end of the shaft so that the shaft is inserted in the diaphragm, and is fixed with the screw member, screwed in the shaft in an axial direction of the shaft, via the center plate to the shaft, the diaphragm has a rising portion of a circular outer shape formed at the side of the center plate configured so that the rising portion is fitted to the center plate within a through-hole provided at the center of the center plate, the center plate has, on a surface of the center plate, opposite to the diaphragm, a ring rib formed at the side of the outer periphery of the through-hole concentrically with the through-hole, and the screw member has a washer portion formed integrally with the screw member and a diameter of the washer portion is approximately equal to but less than an inner diameter of a bottom surface of the ring rib and the washer portion is formed so as to press a part of the ring rib when the center plate comes off from the rising portion of the diaphragm and is subject to maximum deviation between an axis of the through-hole and an axis of the screw member.

2. The electromagnetically driven fluid pump having a center plate with a function of centering according to claim 1, wherein a cross-section of a wall surface of the ring rib, at a center axis side of the ring rib, is in a tapered or curved form so that the diameter of the ring rib increases in the direction from its bottom to its top.

3. The electromagnetically driven fluid pump having a center plate with a function of centering according to claim 1, wherein a peripheral edge portion of the center plate is formed so as to be curved away from the diaphragm.

4. The electromagnetically driven fluid pump having a center plate with a function of centering according to claim 2, wherein a peripheral edge portion of the center plate is formed so as to be curved away from the diaphragm.

5. The electromagnetically driven fluid pump having a center plate with a function of centering according to claim 1, wherein the center plate is formed from a resin.

6. The electromagnetically driven fluid pump having a center plate with a function of centering according to claim 2, wherein the center plate is formed from a resin.

7. The electromagnetically driven fluid pump having a center plate with a function of centering according to claim 3, wherein the center plate is formed from a resin.

8. The electromagnetically driven fluid pump having a center plate with a function of centering according to claim 4, wherein the center plate is formed from a resin.

* * * * *